United States Patent [19]

Hikami et al.

[11] Patent Number: 5,059,133

[45] Date of Patent: Oct. 22, 1991

[54] ZERO INSERTION FORCE CONNECTOR ACTUATED BY A STORED SHAPE MEMBER

[75] Inventors: Toshiya Hikami; Koji Yoshida; Yuichi Obara; Kenichi Fuse, all of Hiratsuka, Japan

[73] Assignee: The Furukawa Electric Co., Ltd., Tokyo, Japan

[21] Appl. No.: 535,652

[22] Filed: Jun. 11, 1990

Related U.S. Application Data

[63] Continuation of Ser. No. 297,327, Jan. 17, 1989, Pat. No. 4,952,162, which is a continuation of Ser. No. 94,756, Sep. 10, 1987, Pat. No. 4,846,729.

[30] Foreign Application Priority Data

| | | | |
|---|---|---|---|
| Sep. 10, 1986 | [JP] | Japan | 61-211491 |
| Sep. 10, 1986 | [JP] | Japan | 61-211493 |
| Sep. 17, 1986 | [JP] | Japan | 61-219060 |
| Jan. 30, 1987 | [JP] | Japan | 62-18652 |
| Feb. 26, 1987 | [JP] | Japan | 62-43947 |
| Feb. 26, 1987 | [JP] | Japan | 62-43948 |
| Mar. 3, 1987 | [JP] | Japan | 62-46766 |
| Mar. 9, 1987 | [JP] | Japan | 62-52173 |
| May 15, 1987 | [JP] | Japan | 62-71774 |
| Jun. 4, 1987 | [JP] | Japan | 62-138936 |
| Jun. 18, 1987 | [JP] | Japan | 62-150228 |

[51] Int. Cl.[5] ..... H01R 13/629

[52] U.S. Cl. ..... 439/161

[58] Field of Search ..... 439/161, 197, 260, 263, 439/264, 268, 630, 633–637

[56] References Cited

U.S. PATENT DOCUMENTS

| | | | |
|---|---|---|---|
| 2,857,577 | 10/1958 | Vanderpool | 439/260 |
| 4,487,465 | 12/1984 | Cherian | 439/260 |
| 4,643,500 | 2/1987 | Krumme | 439/161 |

OTHER PUBLICATIONS

IBM Bulletin, Brain, vol. 13, No. 11, p. 3567, 4–1971.

*Primary Examiner*—Neil Abrams
*Attorney, Agent, or Firm*—Foley & Lardner

[57] ABSTRACT

An electronic connector which has a plurality of contacts associated in one or more rows in a connector housing, a shape memory spring associated in the connector housing for driving the contacts, the shape memory spring transmitting a recovery force generated when the shape memory spring reaches its transformation temperature or higher to the contacts while recovering the shape stored when the shape memory spring reaches its transformation temperature or higher and returning to the shape before the shape memory recovery by the spring force of the contact when the shape memory spring reaches below its transformation temperature. Thus, the electronic connector can mount or dismount contacts at each other without inserting or removing force or substantially without inserting or removing force in a simple structure with less number of parts.

5 Claims, 9 Drawing Sheets

ZERO INSERTION FORCE CONNECTOR ACTUATED BY A STORED SHAPE MEMBER

This application is a continuation of application Ser. No. 07/297,327, filed Jan. 17, 1989, now U.S. Pat. No. 4,952,162 which is a continuation of application Ser. No. 07/094,756, filed Sept. 10, 1987, now U.S. Pat. No. 4,846,729, issued July 11, 1989.

BACKGROUND OF THE INVENTION

This invention relates to an electronic connector capable of inserting or removing an opposite contact with a low inserting or removing force or without an inserting or removing force and in combination with a shape memory spring as an actuator of the contact.

Recently, as integrated circuits (such as ICs, LSIs) have progressed, electronic devices and equipment have become further enhanced in density and in function. Thus, the pitch of the contacts of connectors has been narrowed, and the number of the contacts has been increased. Here, indispensable problems arise in which inserting and removing forces of electronic parts or circuit boards have been increased as the number of contacts have been increased so that unreasonable forces must be exerted. When the components and the boards are inserted or removed by the unreasonable forces, the terminals of the circuit board to be inserted or the circuit board itself may become deformed or damaged or cause the contacting portion of the connector to be damaged or to be, in the worst case, broken.

In order to solve the above-mentioned problems and hence to reduce the inserting and removing forces of the components or the circuit boards, an electronic connector of the noninserting and nonremoving force type associated with a shaped memory spring as an actuator of a contact has been proposed in U.S. Pat. No. 4,643,500 issued to Krumme on Feb. 17, 1987.

However, since the conventional electronic connector has ordinarily employed a spring as a bias spring or a cam mechanism, its structure is complicated and the number of parts is increased so that there may arise problems related to high density and low cost production.

SUMMARY OF THE INVENTION

Accordingly, an object of this invention is to provide an electronic connector which can eliminate the above-described problems and drawbacks and which can mount or dismount contacts with each other without an inserting or removing force or substantially without an inserting or removing force which is of a simple structure with a reduced number of parts.

In order to achieve the above and other objects, there is provided according to this invention an electronic connector comprising a plurality of contacts associated in a row in a connector housing, a shape memory spring associated in the connector housing for driving the contacts, the shape memory spring having a beginning shape and transmitting a recovery force to the contacts generated when the shape memory spring reaches its transformation temperature or higher while recovering the stored shape when the shape memory spring reaches its transformation temperature or higher and returning to the beginning shape by the spring force of the contacts when the shape memory spring reaches below its transformation temperature.

The above and other related objects and features of the invention will be apparent from a reading of the following description of the disclosure found in the accompanying drawings and the novelty thereof defined in the appended claims.

DESCRIPTION OF THE PREFERRED EMBODIMENTS

Embodiments of an electronic connector according to the present invention will be described in detail with reference to the accompanying drawings.

Figure 1:
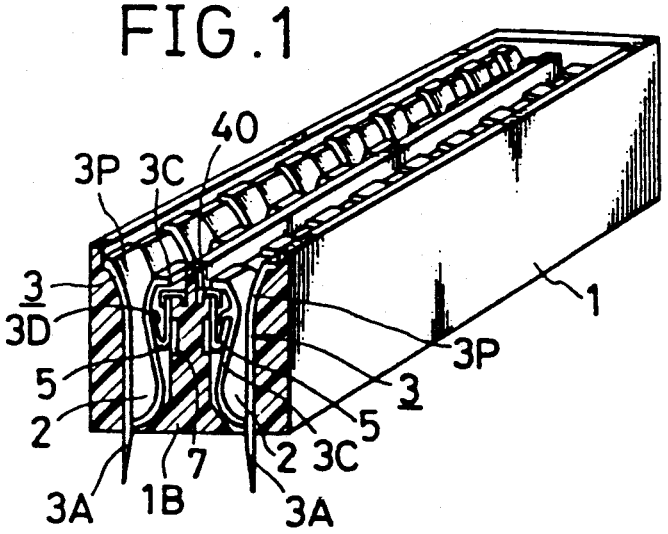
FIG. 1 is a perspective view showing a first embodiment of an electronic connector according to the present invention.
Figure 2:
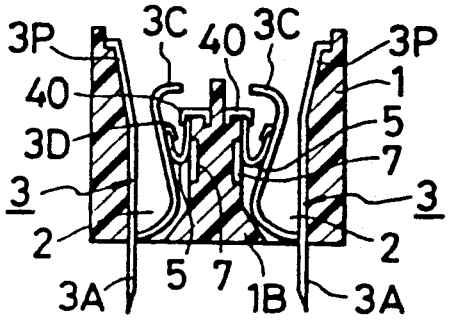
FIG. 2 is a cross-sectional view of the first embodiment.
Figure 3:
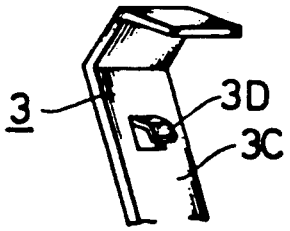
FIG. 3 is a perspective view showing an example of a contact of the first embodiment.

FIGS. 1 to 3 show a first embodiment of an electronic connector of the present invention. As shown in FIGS. 1 to 3, the electronic connector of the first embodiment comprises a connector housing 1 made of an insulating material. The connector housing 1 has two rows of contact containing chambers 2 opened at its front surface. A plurality of contacts 3 are contained longitudinally in a row in an aligned state in each contact containing chamber 2 in such a manner that legs 3A of the respective contacts 3 pass externally through the bottom of the connector housing 1. Each contact 3 has a contact base portion 3P and a contact spring portion 3C formed substantially in U-shape with the contact base portion 3P. A shape memory spring holding portion 3D is formed, as shown in FIG. 3, by a tongue extending from the contact spring portion 3C. Thus, one end of a shape memory spring 5, to be described later, is inserted into the shape memory spring holding portion 3D of the contact 3 to couple the shape memory spring 5 to the shape memory spring holding portion 3D. The shape memory springs 5 are respectively individually provided at the contacts 3 to be disposed to individually drive the contacts 3. The shape memory spring 5 is formed, for example, of nickel (Ni)-titanium (Ti) alloy or the like, and is formed in U-shaped or V-shaped cross section. Each shape memory spring 5 is inserted at its one end into the shape memory spring holding portion 3D of the contact spring portion 3C to be connected as described above, and is supported at its other end to the central partition portion 1B of the connector housing 1 by a cantilever clamp 40. Reference numeral 7 designates a panellike heater mounted on the surface of the partition portion 1B of the connector housing 1 for heating the shape memory spring 5.

In the embodiment described above, the transformation temperature of the shape memory spring 5 is set to 80° C. Accordingly, the shape memory spring 5 remains in the martensitic phase at ambient temperatures to be soft and to be apparently readily plastically deformed. When the shape memory spring 5 is heated to 80° C. or higher, the shape memory spring 5 is transformed into the austenitic phase to recover the shape stored in advance, thereby generating a large force.

Figure 4:
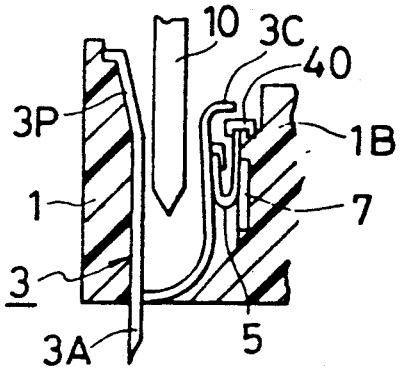
FIGS. 4 and 5 are explanatory views showing the operating state of the first embodiment.
Figure 5:
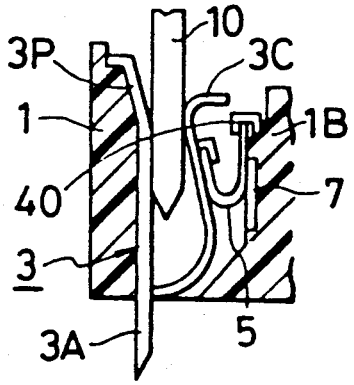

FIGS. 4 and 5 show the operating state of the first embodiment. When the heater 7 is energized to heat the shape memory spring 5 to 80° C. or higher, the shape memory spring 5 in the austenitic phase recovers the shape stored in advance (in this case, the shape memory spring stores the shape to close both the edges thereof) as shown in FIG. 4 so that the force generated overcomes the spring force of the contact spring portion 3C to pull the contact spring portion 3C. In other words, the contact base portion 3P and the contact spring portion 3C are separated therebetween. In this state, an opposite contact 10 can be inserted or removed without an inserting force or removing force. When the heater 7 is then deenergized to lower the temperature of the shape memory spring 5 to ambient temperatures, the shape memory spring 5 in the martensitic phase becomes soft. As a result, as shown in FIG. 5, the spring force of the contact spring portion 3C overcomes that of the shape memory spring 5 to narrow a space between the contact base portion 3P and the contact spring portion 3C, thereby holding the contact 10 therebetween by a predetermined spring force.

When the shape memory spring 5 is heated contrary to the above operation of this embodiment, both the edges of the shape memory spring 5 can be set to open. In this case, the spring force of the contact spring portion 3C overcomes that of the shape memory spring 5 at the ambient temperatures to press the shape memory spring 5 to the partition portion 1B side as shown in FIG. 4. Since the space between the contact base portion 3P and the contact spring portion 3C is wide at this time, the contact 10 can be inserted into or removed there from without an inserting force or removing force. When the shape memory spring 5 is then heated by the heater 7 to 80° C. or higher, the shape memory spring 5 recovers the shape stored in advance (in this case, the shape memory spring 5 stores the shape expanding at both edge thereof) as shown in FIG. 5 to press the contact spring portion 3C by the recovery force generated to the contact 10 by a predetermined contacting pressure. In this case, the shape memory spring holding portion 3D may not be provided.

Figure 6:
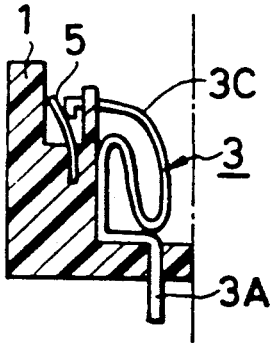
FIGS. 6 and 7 are cross-sectional views showing an applied example of the first embodiment.
Figure 7:
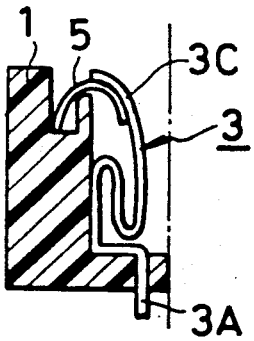

Applied examples of this first embodiment are shown in FIGS. 6 and 7. In the applied examples, the contacts 3 and the shape memory spring 5 are constructed the same as those of the first embodiment except that the shapes of the contact 3 and the shape memory spring 5 are different from those of the first embodiment. In these two applied examples, the shape memory springs 5 are set so that the shape memory springs 5 are in a noninserting force or nonremoving force state at ambient temperatures.

When the shape memory spring 5 is heated in this state, the shape memory spring recovers the stored shape and simultaneously pushes the contact spring 3C to press the contact spring portion 3C toward the contact 10.

Figure 8:
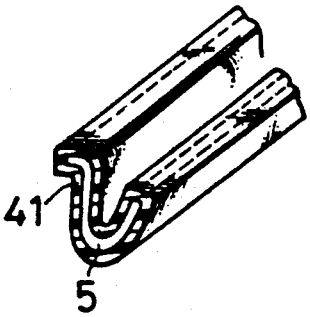
FIGS. 8 and 9 are partial perspective views of a shape memory spring used in another applied example of the first embodiment.

In the first embodiment shown in FIG. 1, the shape memory springs 5 are respectively individually provided at the contacts 3. Thus, there may arise problems in that the number of parts increases, and the forces of the shape memory springs 5 affecting the contacts 3 do not become constant. To solve these problems, the shape memory spring 5 and the contact 3 are insulated therebetween by an insulating material, and the shape memory spring 5 is provided commonly for at least two or more contacts 3, and has a structure such that the shape memory spring 5 is long in the aligning direction of the contacts 3. Thus, there are advantages in that the number of the shape memory springs 5 is remarkably reduced, and the spring force of the shape memory spring 5 applied to the contacts 3 becomes constant. This modified example is shown in FIG. 8. FIG. 8 shows only the shape memory spring 5, in which the other portions thereof are constructed the same as those of the first embodiment shown in FIG. 1, and therefore a detailed description of the modified example will be omitted.

The shape memory spring 5 of the applied modified example in FIG. 8 is common for at least two or more contacts 3, and has a structure such that the shape memory spring 5 is long in the aligning direction of the contacts 3. Further, the surface of the shape memory spring 5 is covered with an insulating film 41 to be described later. Here, a method of covering the surface of the shape memory spring 5 with the insulating film 41 may, for example, be accomplished by spraying a fluorine powder paint or epoxy resin powder paint on the surface of the shape memory spring 5 by electrostatic painting and then baking the paint. To the shape memory spring 5, a covering insulating material such as polyimide resin, polyester resin, fluorine resin or vinyl resin may be extruded, or the surface of the shape memory spring 5 may be covered by bonding an adhesive such as silicon bond to the inner surface of the film or glass cloth made of the above-mentioned resin. The adhesive may include, in addition to the silicon bond, a rubber bond such as SBR (Styrene-butadiene rubber), NBR (Nitrile-butadiene rubber) or resin bond such as epoxy-urethane.

Figure 9:
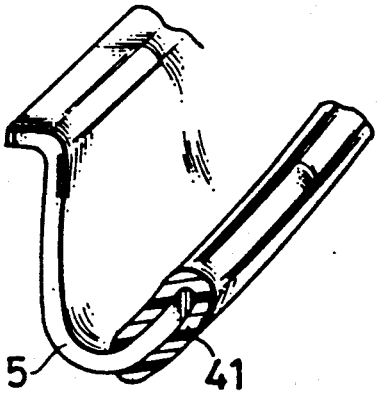

In the modified example in FIG. 8, all the surface of the shape memory spring 5 is covered with the insulating film 41. However, only the portion to be contacted with the contacts 3 may be covered with an insulating film 41 as shown in FIG. 9. Or, only the portion to be contacted with the shape memory spring 5 of the contact 3 side, though not shown, may be covered with the insulating film 41 by various methods as described above.

In the embodiment as described above, the shape memory spring 5 is formed in the structure that is common for the contacts 3, that is to be long in the aligning direction of the contacts 3, and the shape memory spring 5 and the contacts 3 may be insulated therebetween. Therefore, the spring force generated by the shape recovery of the shape memory springs 5 to be applied to the contacts 3 can be aligned constantly. Further, the number of parts can be remarkably reduced. In addition, when such an electronic connector is associated, since the shape memory spring 5 is common for a plurality of contacts 3, there is an advantage in that the shape memory spring 5 may be slid from one end to the other of the connector to be inserted.

Figure 10:
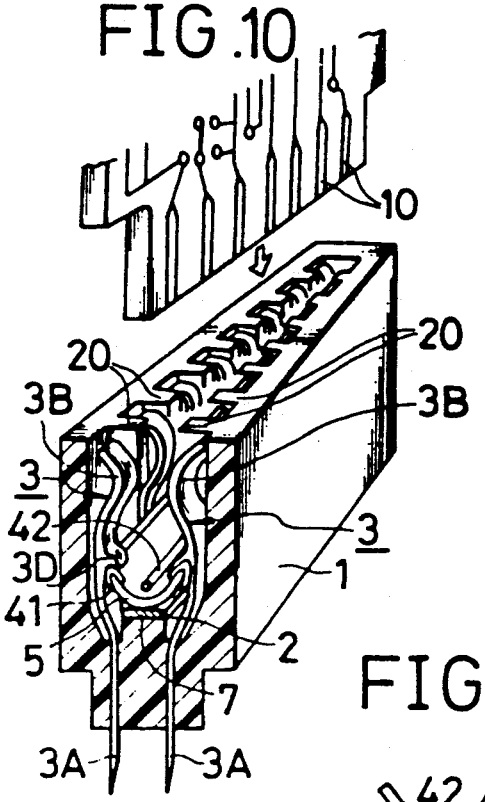
FIG. 10 is a perspective view showing a second embodiment of an electronic connector according to the present invention.
Figure 11:
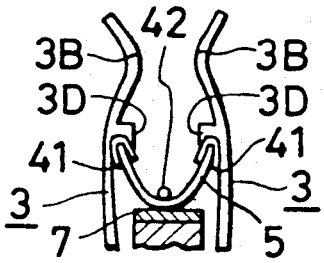
FIGS. 11 and 12 are explanatory views showing the operating state of the second embodiment.
Figure 12:
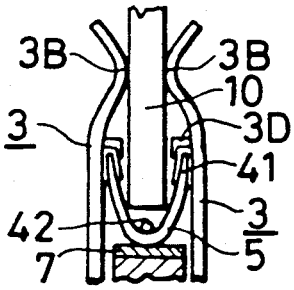

A second embodiment of an electronic connector of the invention is shown in FIG. 10. This second embodiment has such features that a shape memory spring 5 used commonly for at least two or more contacts 3 and having a structure that is long in the aligning direction of the contacts 3 is disposed at the center of two rows of contacts 3 to simultaneously drive the contacts 3 of both the rows by the shape memory spring 5. In the second embodiment as shown in FIG. 10, two rows of a plurality of contacts 3 are associated, and U-shaped sectional configuration memory spring 5 is disposed at the center of the two rows of the contacts 3. The shape memory spring 5 is inserted at both edges thereof into shape memory spring holding portions 3D of the contacts 3. Here, reference numeral 41 designates an insulating film formed on a contacting portion of the shape memory spring 5 with the contacts 3 to insulate the contacts from the shape memory spring 5 in the same manner as that in FIG. 9. Reference numeral 20 denotes a partition wall for insulating the adjacent contacts 3 of the rows to project from the connector housing 1. An attitude holder 42 is placed in a recess of the shape memory spring 5 to stabilize the attitude of the shape memory spring 5 to transmit a balanced spring force to the contacts 3 of both sides. The attitude holder 42 is supported by the side of the connector housing 1. In this second embodiment, the transformation temperature of the shape memory spring 5 is set to 80° C. The operation of the shape memory spring 5 in this case will be described with reference to FIGS. 11 and 12. As shown in FIG. 11, the spring force of both the contacts 3 overcomes that of the shape memory spring 5 at ambient temperature time so that both the contacts 3 are opened at their interval. In this way, the opposite contact 10 can be inserted or removed without inserting force or removing force. When the shape memory spring 5 is then heated by the heater 7 to set the temperature to 80° C. or higher, the shape memory spring 5 tends to recover the shape stored in advance as shown in FIG. 12 (in this case, the shape closed at both edges of the U-shape) to pull both the contacts 3 of both sides inward, with the result that the contacting portions 3B of the contacts 3 are contacted by a predetermined contacting pressure with the contact 10.

According to the second embodiment of the invention constructed as described above, the contacts 3 of the two rows at both sides of the shape memory spring 5 disposed at the center can be simultaneously driven, thereby reducing the number of the shape memory spring 5.

Figure 13:
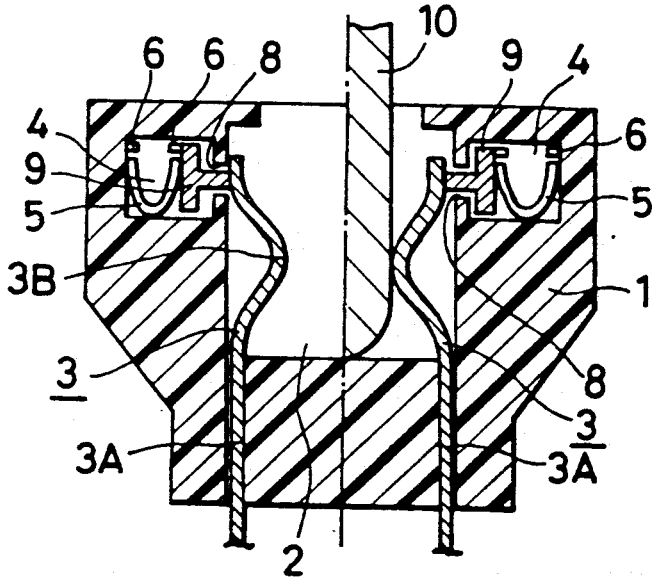
FIG. 13 is a cross-sectional view showing a third embodiment of an electronic connector according to the present invention.

FIG. 13 shows a third embodiment of an electronic connector of the invention. The electronic connector of this third embodiment has a connector housing 1 made of an insulating material, and the connector housing 1 has a contact containing chamber 2 opened at the front surface of the connector housing 1. A plurality of contacts 3 are contained to be oppositely aligned in the contact containing chamber 2 in such a manner that the legs 3B of the contacts 3 pass externally through the connector housing 1 from the bottom. A driving chamber 4 is formed in the connector housing 1 adjacent to the ends of the contacts 3, and U-shaped or V-shaped shape memory spring 5 is positioned by a positioning projection 6 to be contained in the driving chamber 4. The positioning projection 6 is projected from the connector housing 1. The driving chamber 4 communicates with the contact containing chamber 2 via a guide 8 having an opening or a slit. A T-shaped operation transmitting member 9 for transmitting a recovery force generated when the shape memory spring 5 is recovered to the shape stored in advance when the temperature of the shape memory spring 5 is heated to the transformation temperature or higher is interposed between the shape memory spring 5 and the contact 3. The operation transmitting member 9 passes the guide 8 to be restricted in its moving direction by the guide 8, i.e., to be restricted to transmit the force in a normal direction to the contact 3.

This third embodiment is an optimum example as an electronic connector used at burn-in testing time for applying a temperature load as a reliability tester for electronic parts or mounting substrates. In this third embodiment, the shape memory spring 5 made, for example, for Ni-Ti alloy is set to 100° C. of its transformation temperature. Therefore, in this embodiment of the electronic connector, the shape memory spring 5 is in the martensitic phase at ambient temperature so as to be soft and to be apparently readily plastically deformed so that the spring force of the contact 3 overcomes that of the shape memory spring 5 as shown in the left side in FIG. 13. In other words, the contact 3 presses the operation transmitting member 9 by its spring force to the side driving chamber 4, and the contact 3 assumes an attitude that is displaced to the inner wall of the contact containing chamber 2. Therefore, the contact 10 can be inserted or removed without an inserting force or removing force. Then, when the embodiment of this electronic connector is inserted into the burn-in tester the opposite contact 10 is inserted and the testing atmosphere becomes 100° C. or higher, the shape memory spring 5 in the austenitic phase to tends to recover the shape stored in advance, thereby overcoming the spring force of the contact 3 by the recovery force generated to press the operation transmitting member 9 in the direction of the guide 8 as shown in the right side of FIG. 13. Thus, the contact 3 passes to the center of the contact containing chamber 2. Therefore, the contact 3 is pressed to the constant spring force by the contact 10.

In the third embodiment described above, the shape memory spring 5 and the operation transmitting member 9 may be individually provided corresponding to the contacts 3. In this case, the operation transmitting member 9 may be formed of an electrically conductive material.

However, it is preferable that the number of the parts is reduced to simplify the structure and is constructed in a structure such that the shape memory spring 5 is used commonly for at least two or more contacts 3 to stabilize the operation and extends in the aligning direction of the contacts 3. In this case, the operation transmitting member 9 is indispensably composed of an insulating material as in the third embodiment described above. Further, this feature is true for all the following embodiments to be described later. Additionally, in the third embodiment described above, a plurality of contacts 3 have been arranged in two rows in an aligned state. However, this third embodiment can also be applied in the case of one row of contacts at one side. This feature is also applicable to all the following embodiments.

Figure 14:
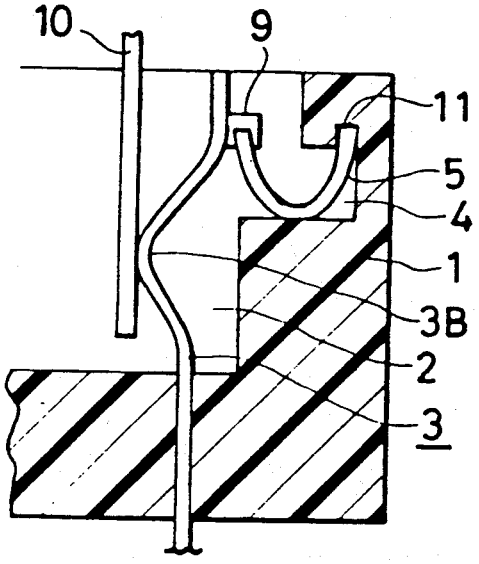
FIG. 14 is a cross-sectional view of an essential portion of a fourth embodiment of an electronic connector of the present invention.

FIG. 14 shows a fourth embodiment of an electronic connector of the invention. Since this fourth embodiment has a symmetry to the right and left sides, the left side will be omitted. Even in this fourth embodiment, a driving chamber 4 which communicates with a contact containing chamber 2 is formed in a connector housing 1 adjacent to the end of each contact 3. The driving chamber 4 contains a U-shaped or V-shaped shape memory spring 5 commonly for at least two or more contacts 3, i.e., having a structure that extends in the aligning direction of the contacts 3. Here, the shape memory spring 5 is inserted at its one end in the operation transmitting member 9, and is inserted, for example, press-fitted at its other end into a groove 11 formed in the connector housing 1. Thus, since the shape memory spring 5 is press-fitted at its other end into the groove 11 of the connector housing 1, the supporting end at operating time is fixed to reliably transmit the force of the shape memory spring 5 to the contact 3. When the groove 11 is continuously formed longitudinally of the connector housing 1, there is an advantage that, after all the contacts 3 are associated in the connector housing 1, the shape memory spring 5 connected with the operation transmitting member 9 is slid from one end of the connector to be mounted, In the fourth embodiment described above, when the atmospheric temperature is lower than the transformation temperature of the shape memory spring 5, the spring force of the contact 3 overcomes that of the shape memory spring 5 to press the shape memory spring 5 to the wall side of the driving chamber 4. In other words, the contact 3 is displaced to the wall side of the contact containing chamber 2, and hence the contact 10 can be inserted with a noninserting force. When the atmospheric temperature thereafter reaches the transformation temperature or higher of the shape memory spring 5, the shape memory spring 5 tends to recover the shape stored in advance to transmit the recovery force generated in this case through the operation transmitting member 9 to the contact 3, while being supported at its one end by the groove 11, with the result that the contact 3 is pressed to the center of the contact containing chamber 2 to cause the contacting portion 3B of the contact 3 to press the contact 10 by a predetermined contacting pressure. In this fourth embodiment, when the shape memory spring 5 and the operation transmitting member 9 are used commonly for at least two or more contacts 3, the operation transmitting member 9 serves as an insulating member of the contacts 3 and also serves as a member for transmitting the spring force of the shape memory spring 5 stably to the contact 3.

In FIG. 14, the operation transmitting member 9 and the shape memory spring 5 may be connected by providing a groove to which one end of the shape memory spring 5 is inserted on the operation transmitting member 9 and pressfitting one end of the shape memory spring 5 to the groove as the connection of the shape memory spring 5 with the connector housing 1.

When the operation transmitting member 9 is, for example, formed of thermoplastic resin, one end of the shape memory spring 5 is inserted in the groove formed on the operation transmitting member 9, and the groove of the operation transmitting member 9 made of the thermoplastic resin is thermally calked so as to be fixed. Thus, the connection of the shape memory spring 5 with the operation transmitting member 9 can be more reliably executed.

Figure 15:
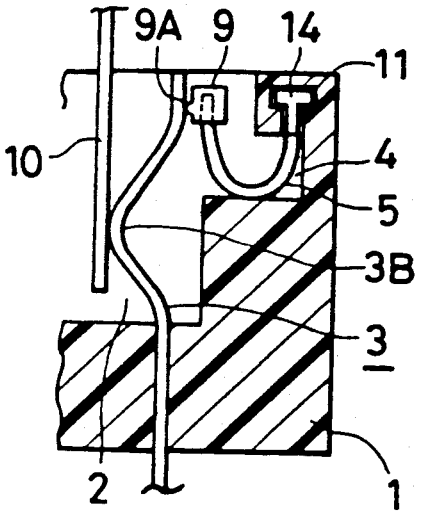
FIG. 15 is a cross-sectional view of an essential portion showing an applied example of the fourth embodiment.

When one end of the shape memory spring 5 is inserted to the groove 11 formed on the connector housing 1, the width of the groove 11 must be matched to the thickness 0.2 to 0.3 mm of the shape memory spring 5 so as to necessarily fix the shape memory spring 5 inserted to the groove 11, and the width of the groove must be very narrow. As a result, there arises a problem in that the forming of the groove 11 becomes very difficult. Even if the groove 11 is precisely formed, when the thin shape memory spring 5 is intended to be press-fitted unreasonably to the groove 11, there occurs a danger of deforming the shape memory spring 5 over the elastic limit in the worst case. Therefore, as shown is FIG. 15, a T-shaped mounting member 14 mounted at one end of the shape memory spring 5, is inserted in the groove 11. In this case, the shape of the groove 11 is naturally formed in a T-shape. In FIG. 15, symbol 9A designates a projection formed on the operation transmitting member 9 to thereby reliably transmit the force of the shape memory spring 5 to the contact 3.

Figure 16:
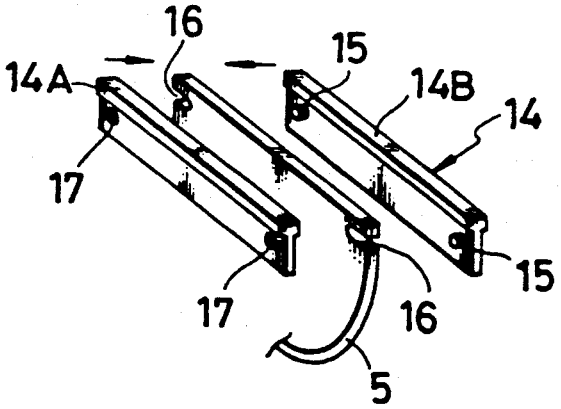
FIGS. 16 and 17 are perspective views showing the mounting method of a mounting member of FIG. 15.
Figure 17:
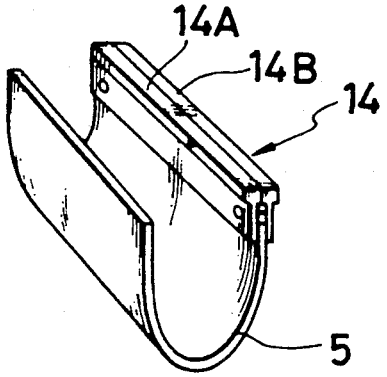
Figure 18:
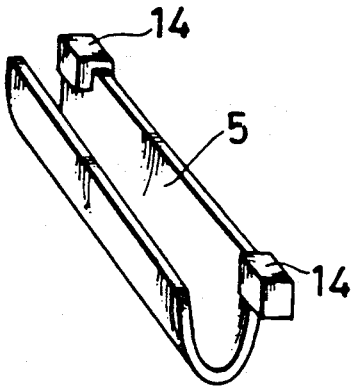
FIG. 18 is a perspective view showing another example of the mounting member.

Here, the mounting member 14 is mounted at one end of the shape memory spring 5, as shown, for example, in FIG. 16, by splitting the mounting member 14 into mounting member pieces 14A, 14B, inserting the projection 15 of one mounting member piece 14B through a cutout 16 in the shape memory spring 5 to engage it with the opening 17 of the opposite mounting member piece 14A to integrate them as shown in FIG. 17. In this case, the mounting member pieces 14A, 14B may be bonded by a bonding material as required. Further, the mounting member 14 may be formed by insert molding at the shape memory spring 5 by direct molding. FIG. 18 shows another example of a mounting member 14. In this case, the mounting member pieces 14 are partially formed at opposite sides.

When the mounting member 14 is provided at the shape memory spring 5 in this manner, the groove 11 of the connector housing 1 is increased in its width, with the result that the groove 11 can be readily formed. Since the shape memory spring 5 is mounted in the groove 11 through the mounting member 14, it is not necessary to forcibly press it to the groove as described above, and can avoid the possibility of bending the shape memory spring 5. As shown in FIG. 15, when the section of the mounting member 14 is formed, for example, in T-shape, there is an advantage that the shape memory spring 5 is prevented from being removed from the groove 11. In FIG. 15, the groove 11 of the connector housing 1 side has been described. However, even when the shape memory spring 5 is inserted into the groove formed on the operation transmitting member 9, the above method may also be applied.

Figure 19:
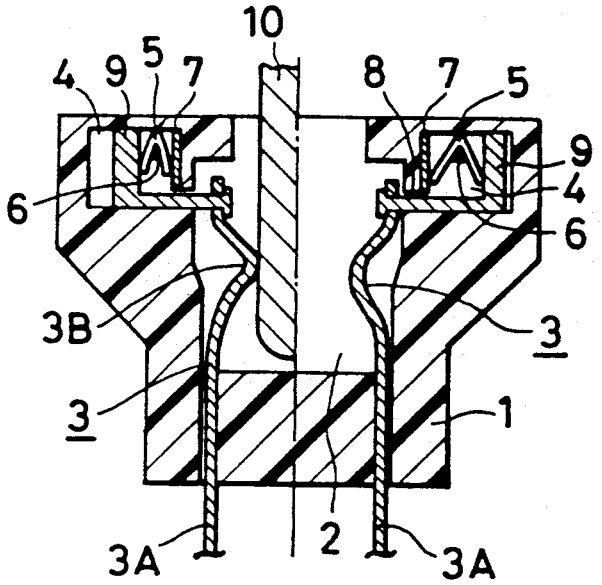
FIG. 19 is a cross-sectional view showing a fifth embodiment of an electronic connector of the present invention.

FIG. 19 shows a fifth embodiment of an electronic connector of the invention. A feature of this fifth embodiment is different from the third embodiment in FIG. 13 in that the contact 3 and the operation transmitting member 9 are connected. Here, reference numeral 6 designates a positioning projection for reversely hanging and positioning a U-shaped or V-shaped shape memory spring 5 to be projected from a connector housing 1. Numeral 7 denotes a heater for heating a shape memory spring 5. The force of the shape memory spring 5 is restricted by a guide 8, having an opening or a slit through an L-shaped operation transmitting member 9 connected to a contact 3, to be reliably transmitted to the contact 3. In this fifth embodiment, the transformation temperature of the shape memory spring 5 is set to 80° C. When the shape memory spring 5 is heated by the heater 7 to 80° C. or higher, the shape memory spring 5 in the austenitic phase tends to recover the shape stored in advance, thereby overcoming the spring force of the contact 3 to assume the state shown on the right side in FIG. 19. More specifically, the operation transmitting member 9 is pulled by the force of the shape memory spring 5 in a direction restricted by guide 8 into a driving chamber 4, thereby pulling the contact 3 to the driving side chamber 4. Accordingly, the contact 10 can be inserted or removed without an inserting or removing force in this state. Then, when the heater 7 is deenergized so that the temperature in the driving chamber 4 reaches ambient temperatures, the shape memory spring 5 is in the martensitic phase to be soft and to be apparently readily plastically deformed. Thus, the spring force of the contact 3 overcomes that of the shape memory spring 5, the contact 3 is protruded to the center side of the contact containing chamber 2, and pressed by a predetermined spring contacting pressure to the contact 10 inserted by the contacting portion 3B of the contact 3 into the contact containing chamber 2. Here, when the operation transmitting member 9 is formed of an insulating member such as plastic, the member 9 can be readily formed, and the shape memory spring 5 and the contact 3 can be reliably insulated.

Figure 21:
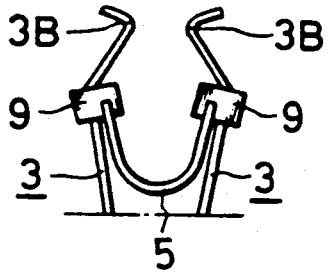
FIGS. 21 and 22 are explanatory views showing the operating state of the sixth embodiment.
Figure 22:
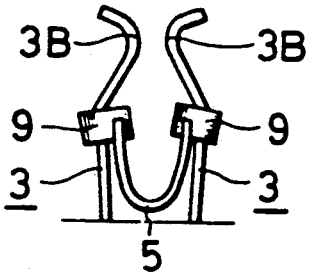
Figure 20:
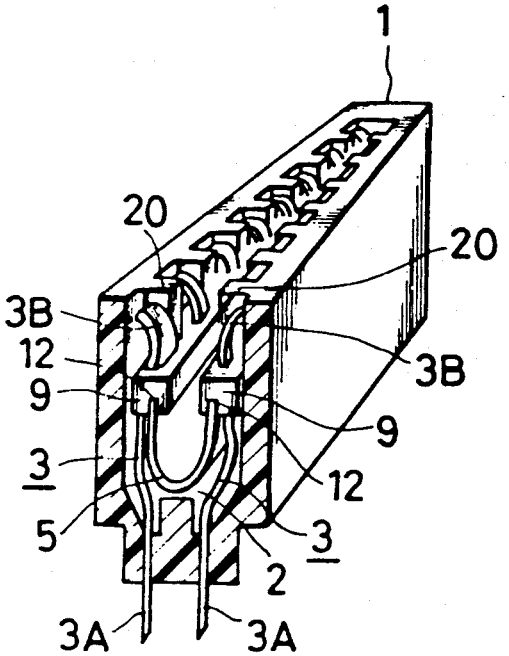
FIG. 20 is a cross-sectional view showing a sixth embodiment of an electronic connector of the invention.

FIG. 20 shows a sixth embodiment of an electronic connector of the invention. In the electronic connector of this sixth embodiment, a contact containing chamber 2 is opened at the front surface of a connector housing 1 made of an insulating material. A plurality of contacts 3 are associated in two rows in parallel longitudinally in the contact containing chamber 2. The contacts 3 of two rows are arranged so that the contacting portions 3B of the contacts 3 of the two rows are opposed to each other as pairs, and U-shaped or V-shaped sectional shape memory spring 5 is disposed to drive the contacts 3 between the contacts 3 of two rows. Further, the shape memory spring 5 is provided commonly for the contacts 3 of both sides along the rows to be inserted at both side edges of the bent recess to grooves 12 formed on operation transmitting member 9 made of an insulating material to simultaneously transmit the tension to the contacts 3 of two rows through the operation transmitting member 9. The contacts 3 are partly inserting to be connected, for example, in the operation transmitting member 9 at molding time, and formed in a structure that the operation transmitting member 9 is supported midway of the contacts 3. As a means for inserting the contacts 3 in the operation transmitting member 9, the above-mentioned molding or means for press-fitting the contacts 3 to openings formed in advance on the operation transmitting member 9 may be used. In this case, it is necessary to eliminate a play between the contact 3 and the operation transmitting member 9 to reliably transmit the force of the shape memory spring 5 to the contact 3. The material of the operation transmitting member 9 may, for example, preferably employ a heat resistance resin having sufficient physical strength such as polyphenylene sulfide, polyetherimide, etc. When a groove 12 for connecting the shape memory spring 5 to the operation transmitting member 9 is continuously formed from one end to the other end of the operation transmitting member 9, the contacts 3 are associated in the connector housing 1, the shape memory spring 5 is then preferably slid from one end to be mounted on the operation transmitting member 9. In this sixth embodiment, the shape memory spring 5 may be bonded by a bond to the operation transmitting member 9 after inserting the shape memory spring 5 to the groove 12 of the operation transmitting member 9. The transformation temperature of the shape memory spring 5 of this sixth embodiment is set to 80° C. When the atmospheric temperature reaches 80° C. or higher, the shape memory spring 5 in the austenitic phase generates a large recovery force. The operation of this sixth embodiment is shown in FIGS. 21 and 22. FIG. 21 shows the state of the shape memory spring 5 at ambient temperatures. In this state, the shape memory spring 5 is in the martensitic phase so as to be soft and to be apparently readily plastically deformed. The shape memory spring 5 is overcome by the spring force of the contact 3 to be opened outside by the spring force of the contact 3 through the operation transmitting member 9. In this state, the contact 10 may be inserted or removed without an inserting or removing force. Then, FIG. 22 shows the state wherein the atmospheric temperature becomes 80° C. or higher and the shape memory spring 5 is in the austenitic phase. In this case, the shape memory spring 5 is recovered to the shape stored in advance, i.e., recovered to the shape for closing at both U-shaped or V-shaped ends to pull the contacts 3 provided in two rows through the operation transmitting member 9, thereby generating a predetermined contacting pressure by the contacting portion 3B of the contact 3 to the contact 10.

This sixth embodiment is designed to obtain a contacting pressure at high temperature. However, the shape memory spring 5 may be provided to insert or remove the contact 10 without an inserting or removing force by altering the memory shape of the shape memory spring 5 (e.g., by storing the shape opened at both ends of U-shape) to generate a predetermined contacting pressure due to the closure of the contact 3 in such a manner that the spring force of the contact 3 overcomes that of the shape memory spring 5 at ambient temperatures, and recovering the shape stored in the shape memory spring 5 at its transforming temperature or higher to open the shape memory spring 5 at the outside.

In the sixth embodiment described above, though the electronic connector has two rows of contacts 3, either row of the contacts 3 may be omitted. In this case, the other end of the shape memory spring 5 is inserted to the groove 11 formed on the connector housing 1 as shown, for example, in FIG. 14 or 15.

Figure 23:
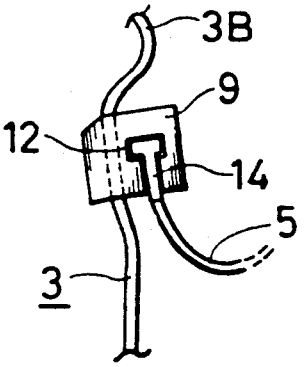
FIG. 23 is an enlarged view of an essential portion of a modified example of the sixth embodiment.

In the sixth embodiment described above, a method of mounting the shape memory spring 5 in the groove 12 of the operation transmitting member 9 may employ a mounting member 14 as shown in FIG. 23. This is the application of the method shown in FIG. 15. Thus, the shape memory spring 5 may not be removed from the groove 12 of the operation transmitting member 9, and there is no possibility that the inserting end of the shape memory spring 5 being excessively bent when inserted.

Figure 24:
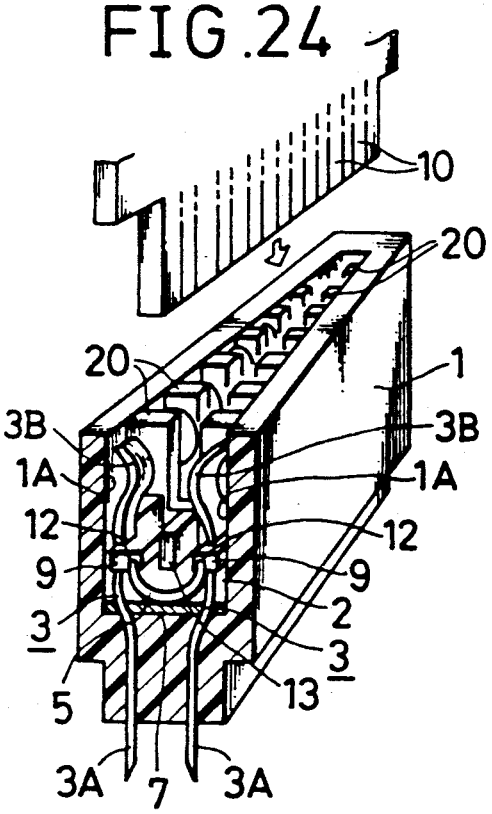
FIG. 24 is a perspective view showing a seventh embodiment of an electronic connector of the invention.
Figure 26:
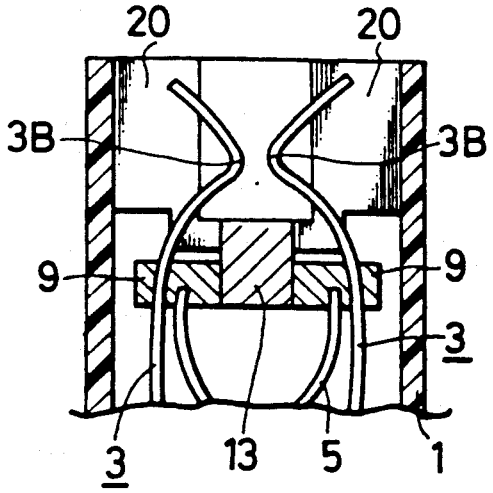
FIGS. 26 and 27 are explanatory views showing the operating state of the seventh embodiment.
Figure 25:
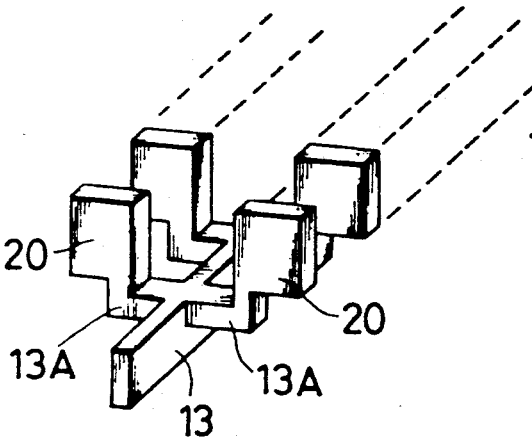
FIG. 25 is a perspective view of a stopper member shown in FIG. 24.
Figure 27:
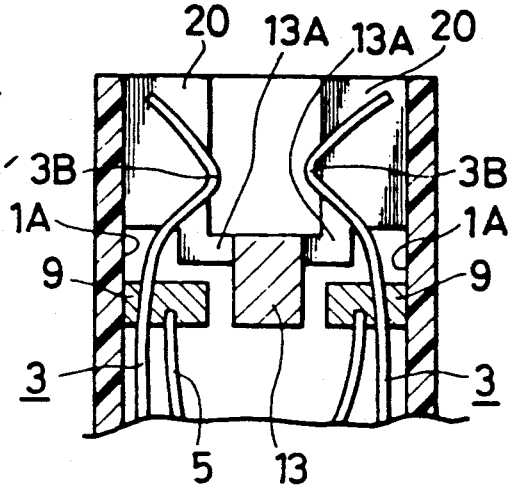

FIG. 24 shows a seventh embodiment of an electronic connector of the invention. This seventh embodiment is modified from the sixth embodiment shown in FIGS. 20 to 22. In the sixth embodiment, the operating ranges of the shape memory spring 5 and the contacts 3 are determined by the balance of the contacts 3 of the bias spring and the force of the shape memory spring 5 with the result that there is a problem in that the contacts 3 cannot be accurately controlled in positioning. In other words, when considering the repetitive fatigue of the shape memory spring 5 and the contacts 3 and the long time restriction of a predetermined deformation amount, it is necessary to accurately manage the strain amount for use in a range such that the strain amount may not exceed a predetermined value. Thus, in FIG. 24, an inner wall 1A of a connector housing 1 for restricting the outward operation range of an operation transmitting member 9 is formed at one side of the operation transmitting member 9 driven by the shape memory spring 5 in the operating direction (lateral direction in FIG. 24), and a stopper member 13 is formed to restrict the operating range of the other inward direction. In the seventh embodiment described above, the stopper member 13 and partition walls 20 are connected by a connecting portion 13A as shown in FIG. 25 to be positioned and contained in a contact containing chamber 2. The stopper member 13, the connecting portion 13A and the partition wall 20 may be integrally formed with the connector housing 1, or the partition 20 is integrally formed with the connector housing 1, and the stopper member 13 may be directly connected to the longitudinal side of the connector housing 1. FIGS. 26 and 27 are cross-sectional views showing the operation of the seventh embodiment. FIG. 26 shows the state, different from the case of FIG. 20, where the electronic connector is to be inserted into or removed from the contact 10 without an inserting or removing force when at high temperature. In this state, the shape memory spring 5 in the martensitic phase is soft and apparently readily plastically deformed. Thus, force of the shape memory spring 5 is overcome by the spring force of the contact 3 to be inwardly pressed through the operation transmitting member 9. At this time, the operation transmitting member 9 is contacted with the stopper member 13 to stop moving inwardly. In FIG. 26, the contact 10 is omitted. However, the contact 3 and the contact 10 are contacted in this state. Then, when the heater 7 disposed between the connector housing 1 and the shape memory spring 5 is energized to heat the shape memory spring 5 to the transformation temperature or higher, the shape memory spring 5 is transformed to the austenitic phase to tend to recover the shape stored in advance (in this case, the shape opened at both side U-shaped ends is stored), thereby expanding the contacts 3 through the operation transmitting member 9 as shown in FIG. 27. At this time the operation transmitting member 9 is contacted with the inner wall 1A of the connector housing 1 to stop moving outward. Accordingly, even if the shape memory spring 5 generates a spring force more than required , a large strain is not applied to the contact 3. The contact 10 not shown in this state can be inserted or removed without an inserting or removing force.

In the seventh embodiment described above, when the shape for closing both ends is stored in the shape memory spring 5 when the shape memory spring 5 reaches its transformation temperature or higher, the shape memory spring 5 can operate reversely as in the cases of FIGS. 26 and 27.

In the seventh embodiment described above, either row of contacts 3 may be omitted similarly to the case of the sixth embodiment. In this case, the other end of the shape memory spring 5 is inserted fixedly in a groove 11 formed on a connector housing 1 as shown, for example, in FIGS. 14 and 15.

Figure 28:
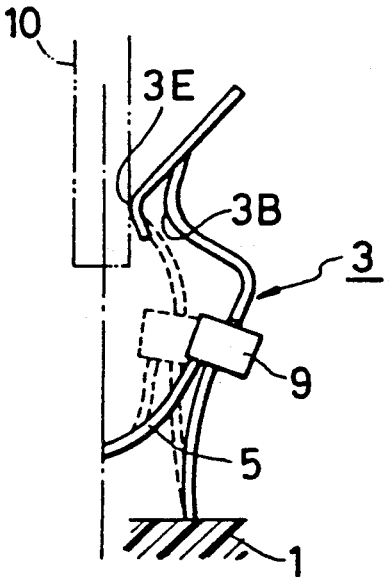
FIG. 28 is a cross-sectional view showing an eighth embodiment of an electronic connector of the invention.
Figure 29:
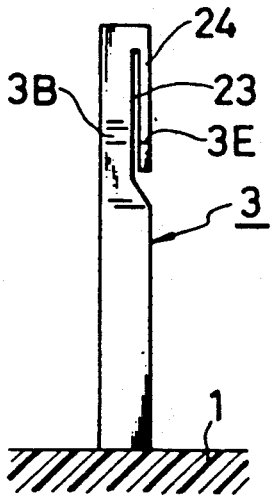
FIG. 29 is a front view of a contact used in the eighth embodiment.

FIG. 28 shows an eighth embodiment of an electronic connector of the invention. This eighth embodiment is modified and improved from the sixth embodiment in FIG. 20 and the seventh embodiment in FIG. 24. More specifically, in the sixth embodiment, the shape memory spring 5 is exposed with high temperature atmosphere, takes several tens of seconds to reaches its transformation temperature, even if the high temperature atmosphere is in the vicinity of transformation temperature of spring 5. In the seventh embodiment, even if the energization of the heater 7 is stopped, it takes a considerable time to generate a contacting pressure between the contacts 3 and the opposite contact 10 due to the narrow interval of the contacts at both sides aligned in two rows as shown in FIG. 26 until the temperature of the shape memory spring 5 falls below its transformation temperature. In this case, the continuity test cannot be performed as described above. In other words, in the above-mentioned embodiments, it takes several tens of seconds to transform the shape of memory spring 5, and there is a problem that even a simple initial check cannot be executed during the period. Therefore, the eighth embodiment has a feature that an initial check such as a continuity check can be executed during the period until the shape memory spring 5 is transformed to the desired phase. In this eighth embodiment as shown in FIG. 28, the contacts 3 have weak spring force auxiliary contacting portions 3E which stand by at positions to make contact before a strong spring force main contacting portion 3B contacts the contact 10. This weak spring force auxiliary contacting portion 3E is formed with a narrow auxiliary spring portion 24 so that a slit 23 is formed from the upper portion toward the lower portion to become a weak spring force as shown in FIG. 29, and the auxiliary spring portion 24 is extended to the center of the contact containing chamber 2 as shown in FIG. 28.

In the electronic connector of the eighth embodiment described above, when the shape memory spring 5 is, for example, in the martensitic phase, the weak spring force auxiliary contacting portion 3E is extended inward to stand by. Accordingly, the contact 10 can contact the weak spring force auxiliary contacting portion 3E before contacting the strong force main contacting portion 3B, and even if the shape memory spring 5 is not transformed to the austenitic phase, i.e., is not heated, the initial check can be executed. When the shape memory spring 5 is heated to be transformed to the austenitic phase, the contact 3 is moved to the center of the contact containing chamber 2 through the operation transmitting member 9 by the force of the shape memory spring 5, and the strong spring force main contacting portion 3B is contacted with the opposite contact 10. More particularly, in FIG. 28, the shape memory spring 5 is in the martensitic phase at ambient temperature, and is stopped in balance with the contact 3. Since the strong spring force main contacting portion 3B is disposed steadily at the position slightly retreated with respect to the contact 10 from the weak spring force auxiliary contacting portion 3E, only the weak spring force auxiliary contacting portion 3E is contacted when the contact 10 is inserted. Thus, the contact 10 can be inserted with extremely weak force. The necessary minimum contacting pressure is generated for an initial check at this time. After the initial check is completed, when the shape memory spring 5 arrives at a high temperature state, the shape memory spring 5 is transformed to the austenitic phase, becoming the stored shape, i.e., the state as shown by broken lines in FIG. 28. As a result, the strong spring force main contacting portion 3B is contacted with the contact 10 by a large contacting pressure, and high reliability is obtained even in the continuous usage at high temperature. When returned again to ambient temperature, the shape memory spring 5 is stopped at the position designated by solid lines in FIG. 28, and the opposite contact 10 and the contact 3 are contacted only at the weak spring force auxiliary contacting portion 3E.

Even in case of an electronic connector used at ambient temperature, when this contact 3 is applied, the initial check can be executed immediately after the heater 7 is deenergized, and a high contacting pressure is obtained when the temperature falls below the transformation temperature of the shape memory spring 5.

Figure 30:
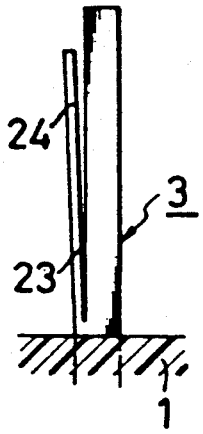
FIG. 30 is a front view of a contact used in an applied example of the eighth embodiment.
Figure 31:
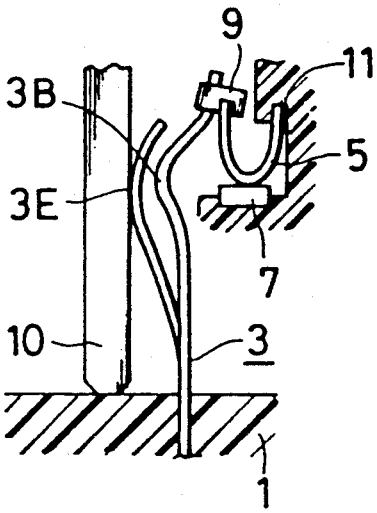
FIGS. 31 and 32 are explanatory views showing the operating state of the case in which the contact shown in FIG. 30 is used.
Figure 32:
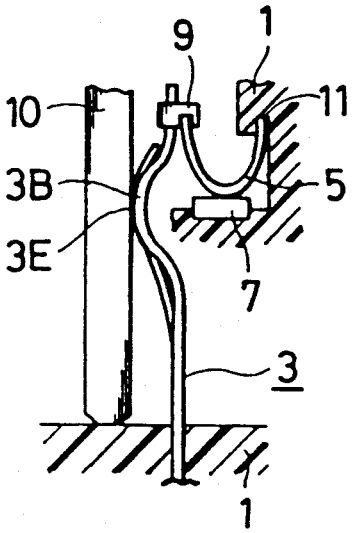

FIG. 30 shows another modified example of this eighth embodiment. The contact 3 is different from that in FIG. 29, a slit 23 is formed from the upper portion to the lower portion of the contact 3 to form an auxiliary spring portion 24. Thus, a weak spring force auxiliary contacting portion 3E is stopped at a predetermined position substantially irrespective of the movement of the strong spring force main contacting portion 3B driven by the shape memory spring 5 different from that in FIG. 17. An example of using the contact 3 is shown in FIGS. 31 and 32. This electronic connector is used at ambient temperature. In this example, the outwardly pulling force of the shape memory spring 5 in the austenitic state heated by the heater 7 as shown in FIG. 31 is transmitted through the operation transmitting member 9 to the contact 3, and the strong spring force main contacting portion 3B of the contact 3 is pulled to the inner wall side of the connector housing 1. In this state, only the weak spring force auxiliary contacting portion 3E remains at the center of the contact containing chamber 2. Accordingly, the contact 10 is contacted with the weak spring force auxiliary contacting portion 3E by a weak contacting pressure. Therefore, an initial check can be executed by the weak spring force auxiliary contact 3E during several tens of seconds before the heater 7 is stopped and the shape memory spring 5 is returned to the martensitic phase. After the several tens of seconds, the shape of memory spring 5 is returned to the martensitic state. Then, as shown in FIG. 32, the spring force of the contact 3 overcomes the spring force of the shape memory spring 5 to return to the center of the contact containing chamber 2, with the result that the contacting pressure of the strong spring force main contacting portion 3B is added to the contacting pressure of the weak spring tension auxiliary contacting portion 3E to act as a large contacting pressure on the contact 10.

FIGS. 33 to 37 show a ninth embodiment of an electronic connector of the invention. The eighth embodiment in FIG. 28 forms the auxiliary spring portion 24 by forming the slit 23 on the contact 3, while the ninth embodiment is improved to provide the same advantages as those in the eighth embodiment by contact 3. The portions except the contact 3 are constructed fundamentally the same as the sixth embodiment in FIG. 20, and only the feature of the ninth embodiment will be shown and described. In the ninth embodiment, the contact 3 is composed of a contact weak spring portion 3F erected from the bottom of a connector housing 1 in a contact containing chamber 2 so that the upper end is bent in a predetermined radius of curvature downward, and a contact strong spring portion 3G formed continuously to the end of the contact weak spring portion 3F to be bent in a V-shape. The contacting portion 3B is formed at a boundary between the contact weak spring portion 3F and the contact strong spring portion 3G. A blocklike operation transmitting member 9 is formed on the contact weak spring portion 3F corresponding to the contact strong spring portion 3G. One end of the shape memory spring 5 is press-fitted to the groove 12 of the operation transmitting member 9. An engaging portion 3K is formed substantially perpendicularly bent at the end of the contact strong spring portion 3G. The engaging bent portion 3K is placed on the upper surface of the operation transmitting member 9.

Figure 33:
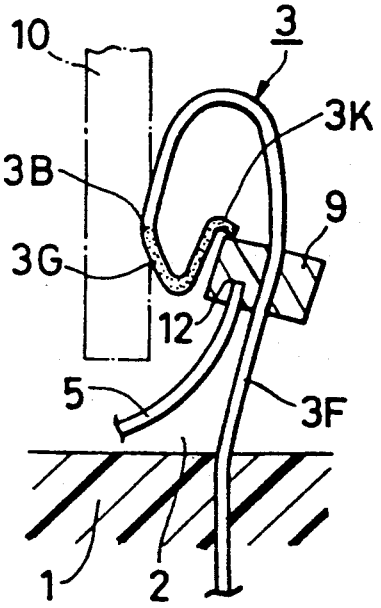
FIGS. 33 and 34 are cross-sectional views of an essential portion showing the operating state of a ninth embodiment of an electronic connector of the invention.
Figure 36:
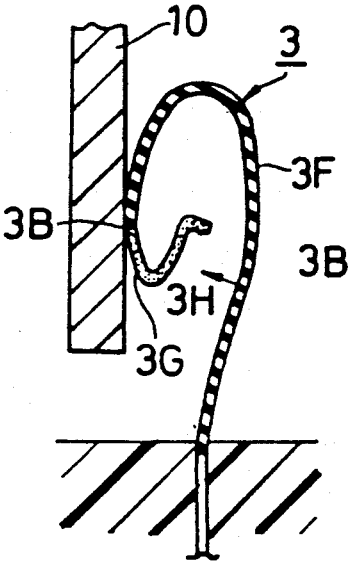
Figure 37:
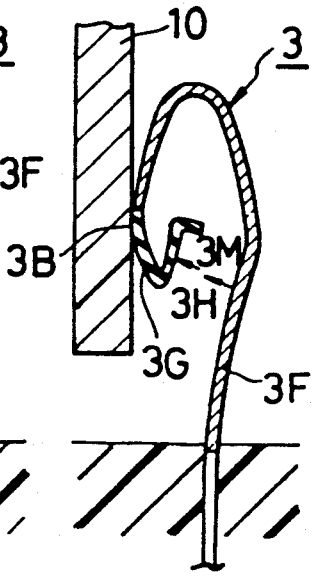

In the electronic connector of the ninth embodiment described above, when the atmosphere is at ambient temperature and the shape memory spring 5 is in the martensitic state, the contacting portion 3B is disposed steadily at a position contacted when the opposite contact 10 is inserted as shown in FIG. 33. In this state, the spring force of the contact weak spring portion 3F of the heavy cross-hatched portion in FIG. 35 at load acting point 3H is balanced with the force of the shape memory spring 5. Then, when the opposite contact 10 is inserted as shown in FIG. 36, the contacting portion 3B is pressed back to the surface line of the opposite contact 10 to generate a predetermined weak contacting pressure to be in the state such that an initial check can be executed. At this time, the spring force of the contact 3 affecting the contacting pressure is generated at the portion of the contact weak spring portion 3F of heavy cross-hatched portion in FIG. 36. The stiffness at this time is that generated by the contact weak spring portion 3F so as to be very weak as compared with that of the state of FIG. 37 to be described later, and even if the position of the contacting portion 3B is slightly displaced, the contacting pressure does not alter to a greater extent.

Figure 34:
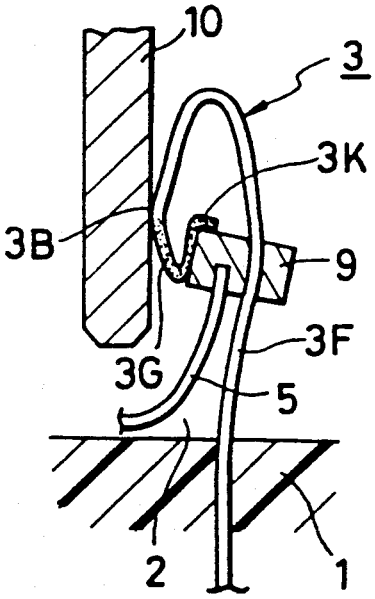
Figure 35:
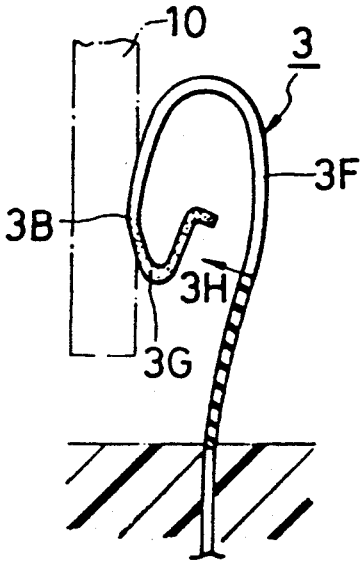
FIGS. 35 to 37 are explanatory views showing the spring force generating state of the contact in the ninth embodiment.

When the electronic connector of this ninth embodiment is exposed to the high temperature state, i.e., the transformation tempera[illegible] or higher of the shape memory spring 5 after [illegible] contact 10 is inserted, the shape memory spring 5 in the austenitic phase overcomes the spring force of the contact 3, and tends to recover to the stored shape, thereby stopping in the state in FIG. 34. As a result, the contacting point 3B is contacted with the contact 10 by a large contacting pressure to obtain a high reliability in continuous operation at high temperatures. At this time, the spring force of the contact 3 affecting the contacting pressure is initially generated by the contact weak spring portion 3F of heavy cross-hatched portion in FIG. 36, but as the shape memory spring 5 recovers its shape, the spring force of the contact 3 is generated from when the operation transmitting member 9 is contacted with the oblique surface of the contact strong spring portion 3G in both the heavy cross-hatched portion and in the light cross-hatched portion in FIG. 37. The load acting point at this time becomes two points 3H and 3M in FIG. 37, and particularly the heavy cross-hatched portion provides a large stiffness of the contact strong spring portion 3G, and the shape recovering force of the shape memory spring 5 is transmitted to the contacting portion 3B substantially as it is.

In the electronic connector of this ninth embodiment of this type, it is preferable not to deform the contact 3 as low as possible, i.e., to increase the stiffness so as to utilize the force of the shape memory spring 5 as the contacting pressure, but when it is, on the contrary, necessary to contact the contact 10 with the contact 3 by a weak spring force for the purpose of an initial check, the stiffness of the contact 3 is preferably smaller. In the ninth embodiment, this requirement is satisfied by altering the stiffness at the load acting point of the contact 3 during the period when the operations of the contact 3 and the shape memory spring 5 have been completed upon rising of the temperature after the contact 10 is inserted.

The contact 10 is wiped on the surface by the contacting portion 3B of the contact 3 when the contact 10 is initially inserted, but in this ninth embodiment, the contacting point of the contacting portion 3B and the opposite contact 10 is not always altered thoroughly during a series of operations of the contact 3 and the shape memory spring 5 described above. Therefore, contact of extremely high reliability is obtained from an electrical point of view.

When at ambient temperature, the transformation temperature of the shape memory spring 5 is set to a low temperature such as 0° C., and when the contact 10 is inserted, the electronic connector is cooled. Then, similar effects to those described above are obtained. In the ninth embodiment described above, this can be applied to both one and two rows of the contacts 3 in the same manner as the embodiment described above.

According to the ninth embodiment described above, different from the eighth embodiment, the contact 3 is composed of the contact weak spring portion 3F and the contact strong spring portion 3G, the contacting portion 3B is formed at the boundary between both the spring portions, the memory recovery force of the shape memory spring 5 is acted through the operation transmitting member 9 to the contact strong spring portion 3G, and the contacting portion 3B is disposed at the position capable of contacting when the contact 10 is inserted in the stand-by state. Therefore, the contacting portion 3B extended to the inserting passage of the contact 10 is supported by the contact weak spring portion 3F at the initial check time by contacting the contact 10 with the contact 3, thus there is an advantage that it is moved by the weak force when pressed so that the initial check can be executed by an extremely weak inserting or removing force. When the shape memory spring 5 is operated, the force of the shape memory spring 5 acts through the operation transmitting member 9 to the contact strong spring portion 3G of the contact 3. Thus, the attenuation of the force of the shape memory spring 5 is minimized to transmit the force of the shape memory spring 5 to the contacting portion 3B to obtain a necessary contacting pressure different from the contact weak spring portion 3F. Further, different from the embodiments described above, this ninth embodiment has an advantage that the surface of the contact 10 is wiped when the contact 10 is inserted.

Figure 38:
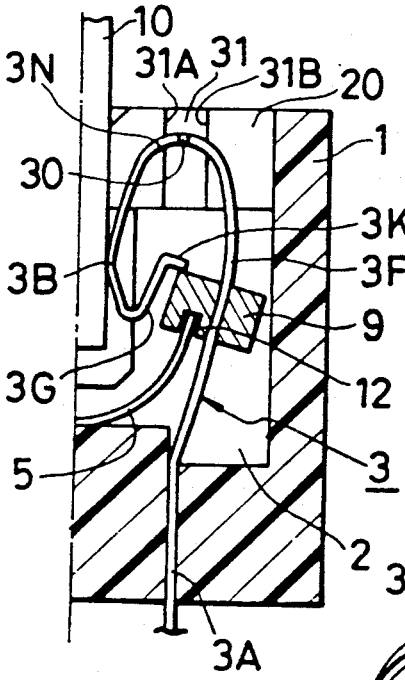
FIG. 38 is a cross-sectional view showing an essential portion of a tenth embodiment of an electronic connector of the invention.
Figure 39:
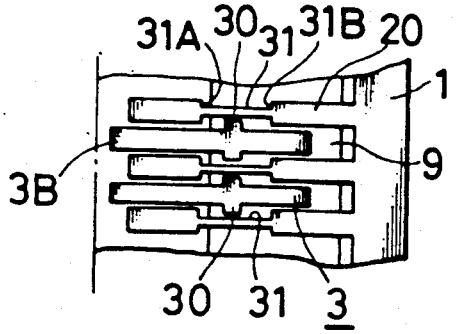
FIG. 39 is a plan view of an essential portion of the tenth embodiment.
Figure 40:
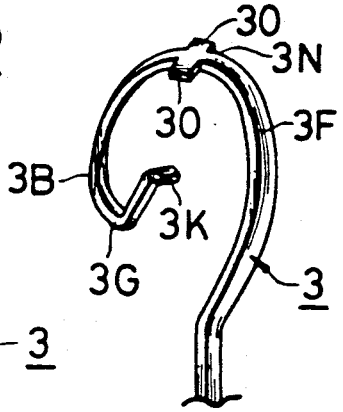
FIG. 40 is a perspective view of a contact of the tenth embodiment.

FIGS. 38 to 40 show a tenth embodiment of an electronic connector of the invention. This tenth embodiment is improved to accurately manage the position of the operating range of the contact 3 in the ninth embodiment for the purpose of improving fatigue characteristics by eliminating the strain of the contact 3 exceeding a predetermined amount.

In the tenth embodiment, the electronic connector has a symmetry at right and left sides, and left half will be omitted for the clarity of the drawings and the description. Since the essential portion of the tenth embodiment is substantially the same as that of the ninth embodiment in FIGS. 33 to 37, the description of the same portions will be omitted.

In FIGS. 38 to 40, a first restricting portion 30 made of a projection for restricting the operating range of the contact 3 is formed on the side of the folded portion 3N of the contact weak spring portion 3F of the contact 3. A second restricting portion 31 made of a recess for restricting the operating range of the contact 3 in cooperation with the first restricting portion 30 is formed correspondingly on the partition wall 20 between the contacts 3 of the rows. The first and second restricting portions 30, 31 contact with one another to restrict the operating range of the contact 3.

In the electronic connector of the tenth embodiment described above, when the opposite contact 10 is inserted at ambient temperature, the first restricting portion 30 stops at the stopper 31B of the second restricting portion 31 to always exert a predetermined contacting pressure. The shape memory spring 5 recovers its shape in a direction such that the shape memory spring 5 is contracted inward at a high temperature, i.e., at the transformation temperature or higher of the shape memory spring 5. In this case, even if the shape memory spring 5 produces a force more than required, the contact 3 is contacted at the first restricting portion 30 with the stopper 31A of the second restricting portion 31 to be restricted. Thus, the contact 3 does not exceed the critical strain.

Figure 42:
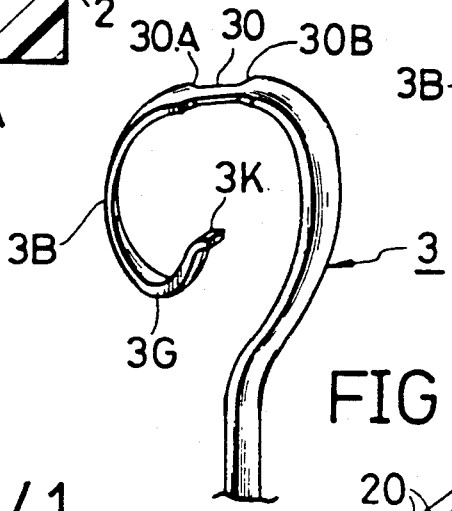
FIG. 42 is a perspective view of the contact of the tenth embodiment.
Figure 41:
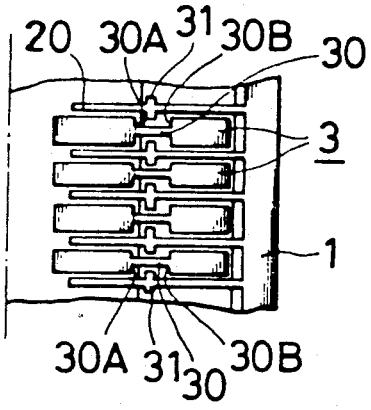
FIG. 41 is a plan view of an essential portion showing an applied example of the tenth embodiment.

FIGS. 41 and 42 show an applied example of the tenth embodiment. This applied example is different from the tenth embodiment in that a first restricting portion is formed with a recess and used at both ends as stoppers 30A, 30B and a second restricting portion 31 is formed with a projection.

In the electronic connector of the applied example of the tenth embodiment described above, the contact 3 overcomes the spring force of the shape memory spring 5 at ambient temperature to tend to open outward, but the stopper 30A contacts the second restricting portion 31, thereby becoming a predetermined contacting pressure when the opposite contact 10 is inserted. When the atmospheric temperature rises to the transformation temperature or higher of the shape memory spring 5 so that the spring force of the shape memory spring 5 overcomes the spring force of the contact 3 to cause the shape memory spring to recover the shape in an inwardly contracting direction, even if the contact 10 is not inserted, the stopper 30B of the first restricting portion 30 formed on the contact 3 is stopped by the second restricting portion 31 formed on the partition wall 20 to inhibit exceeding the critical strain of the contact 3. When there is a facing contact 3, i.e., when the contacts 3 are opposite in two rows, it prevents the facing contacts 3 from contacting with one another. In the tenth embodiment, the electronic connector has been used at a high temperature. However, in case of the electronic connector used at ambient temperature, the transformation temperature of the shape memory spring 5 is set, for example, to 0° C., the electronic connector is cooled when the contact 10 is inserted, and it may be exposed to the ambient temperature when the opposite 10 is inserted. A heater may be associated in the contact containing chamber 2 of the connector housing 1, and when the contact 10 is inserted, the heater is energized, and the contact 3 is opened by the shape required memory spring 5 for storing in advance the shape to open both ends of its U-shaped portion to insert or remove the contact 10 without an inserting or removing force, and when the energization of the heater is stopped after the contact 10 is inserted, sufficient contacting pressure can be obtained at ambient temperature.

Figure 43:
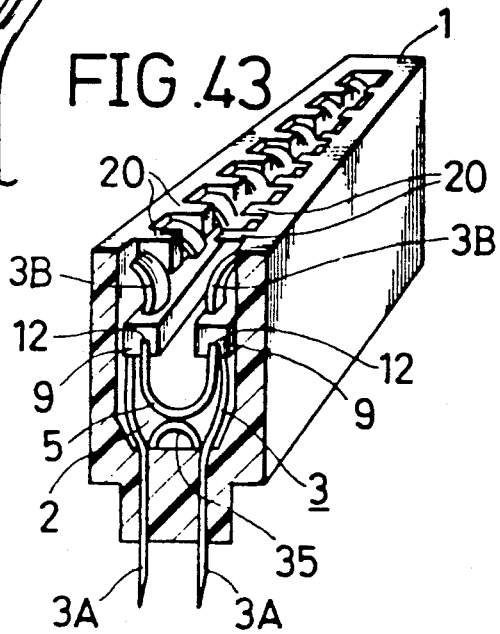
FIG. 43 is a perspective view showing eleventh embodiment of an electronic connector of the invention.

FIG. 43 shows an eleventh embodiment of an electronic connector of the invention. In the eleventh embodiment, in the electronic connector of the type such that U-shaped open edges of a shape memory spring 5 are press-fitted to grooves 12 formed on an operation transmitting member 9, it is devised that the shape memory spring 5 is not removed from the groove 12 of the operation transmitting member 9. In other words, an elastic member 35 is provided between the shape memory spring 5 and the connector housing 1, and the shape memory spring 5 is energized by the elastic member 35 in a direction of the groove 12 of the operation transmitting member 9. As a result, there are advantages in that the shape memory spring 5 is prevented from being removed from the groove 12 of the operation transmitting member 9 and the operating point of the shape memory spring 5 is stabilized. When the elastic member 35 is mounted in the structure where no heater 7 is provided in the electronic connector of the structure in FIG. 31, the elastic member 35 is inserted between the shape memory spring 5 contained in the driving chamber 4 and the bottom of the driving chamber 4, and the shape memory spring 5 is pressed by the elastic member 35 to the groove 12.

According to the electronic connector constructed as described above in accordance with the invention, it is appreciated that the contact 10 can be inserted or removed without or with low a inserting or removing force. The electronic connector of the invention provides a simple structure and high reliability as compared with the conventional connectors. Further, an initial check can be executed as required.

What is claimed is:

1. An electronic LIF connector comprising:

a plurality of resilient contacts associated in one or more rows in a connector housing, a shape memory spring having an initial shape and provided to extend longitudinally with respect to each row in the connector housing for driving the resilient contacts, the shape memory spring, one end of which is associated with an operation transmitting member which is connected to said resilient contacts and which is constructed of electrically insulating material, and which spring drives said resilient contacts through said operation transmitting member, transmitting a recovery force to the resilient contacts, said recovery force being generated when the shape memory spring reaches a transformation temperature or higher, said memory spring recovering a stored shape and returning to the initial shape by the spring force of the resilient contacts when the shape memory spring falls below its transformation temperature; and a plurality of opposite contacts which are selectively insertable in said connector housing opposite said resilient contacts;

and wherein each of said resilient contacts comprises a main portion which has a relatively strong spring force and which is capable of contacting the respective one of said opposite contacts only when said resilient contact is deformed under said recovery force and an auxiliary portion which has a relatively weak spring force and which is capable of contacting the respective one of said opposite contacts whether or not said resilient contact is deformed under said recovery force.

2. The electronic connector according to claim 1, wherein said contacts are communicated with each other through said operation transmitting member and the one end of the shape memory spring is inserted in a groove in the operation transmitting member.

3. The electronic connector according to claim 2, wherein a mounting member is connected to the one end inserted in the groove in the operation transmitting member.

4. An electronic connector comprising:

a plurality of resilient contacts associated in at least one row in a connector housing, a shape memory spring, having an initial shape and provided to extend longitudinally with respect to each row in the connector housing, for driving the resilient contacts, the shape memory spring, one end of which is associated with an operation transmitting member which is constructed of electrically insulating material, and which spring drives said resilient contacts through said operation transmitting member, transmitting a recovery force to the resilient contacts, said recovery force being generated when the shape memory spring reaches a transformation temperature or higher, said memory spring recovering a stored shape and returning to the initial shape by the spring force of the resilient contacts when the shape memory spring falls below its transformation temperature;

wherein said contacts communicate with each other through said operation transmitting member and the one end of the shape memory spring is inserted in a groove in the operation transmitting member; and wherein a mounting member is connected to the one end inserted in the groove in the operation transmitting member.

5. An electronic connector comprising:

a plurality of resilient contacts associated in at least one row in a connector housing; and a shape memory spring, having an initial shape and provided to extend longitudinally with respect to each row in the connector housing, for driving the resilient contacts, the shape memory spring, one end of which is associated with an operation transmitting member which is constructed of electrically insulating material, and which spring drives said resilient contacts through said operation transmitting member, transmitting a recovery force to the resilient contacts, said recovery force being generated when the shape memory spring reaches a transformation temperature or higher, said shape memory spring recovering a stored shape and returning to the initial shape by the spring force of the resilient contacts when the shape memory spring falls below said transformation temperature, the other end of said shape memory spring being associated with a groove formed in said connector housing and having a mounting member fitted thereon, said mounting member being inserted in said groove of said connector housing.

* * * * *